US006769971B2

(12) United States Patent
Gipson

(10) Patent No.: US 6,769,971 B2
(45) Date of Patent: Aug. 3, 2004

(54) MULTISPINDLE PEDESTAL GRINDER

(76) Inventor: Gregory Lee Gipson, 4748 N. 28th Dr., Phoenix, AZ (US) 85017

( * ) Notice: Subject to any disclaimer, the term of this patent is extended or adjusted under 35 U.S.C. 154(b) by 0 days.

(21) Appl. No.: 10/435,885

(22) Filed: May 12, 2003

(65) Prior Publication Data

US 2003/0216114 A1 Nov. 20, 2003

Related U.S. Application Data

(60) Provisional application No. 60/380,416, filed on May 14, 2002.

(51) Int. Cl.[7] ..... B24B 1/00

(52) U.S. Cl. ..... 451/178; 451/28; 451/57; 451/177; 451/211; 451/247

(58) Field of Search ..... 451/28, 57, 177, 451/178, 211, 247

(56) References Cited

U.S. PATENT DOCUMENTS 4,321,843 A * 3/1982 Schwab et al. ..... 76/107 A
5,697,831 A * 12/1997 Reichel ..... 451/246
6,638,139 B2 * 10/2003 Carlson, III ..... 451/5

* cited by examiner

*Primary Examiner*—Joseph J. Hail, III
*Assistant Examiner*—Shantese McDonald

(57) ABSTRACT

A multispindle pedestal grinder includes: a head block, an indexable head rotatably supported by the head block, three spindles rotatably supported by the indexable head, the axes of rotation of the spindles being parallel to one another and to the axis of rotation of the indexable head, a source of rotating power such as an electric motor; and a belt drive selectively coupling only: a first one of the spindles to the source of rotating power when the indexable head is in a first index position; a second one of the spindles to the source of rotating power when the indexable head is in a second index position; and a third one of the spindles to the source of rotating power when the indexable head is in a third index position.

8 Claims, 1 Drawing Sheet

MULTISPINDLE PEDESTAL GRINDER

CROSS-REFERENCE TO PARENT PROVISIONAL APPLICATION

This application relies for priority on parent Provisional Application No 60/380,416, filed May 14, 2002.

FIELD OF THE INVENTION

This invention relates to the machine tool arts and more particularly to machine shop grinders. Still more particularly, this invention relates to a multispindle pedestal grinder.

BACKGROUND OF THE INVENTION

Pedestal grinders are widely used in machine shops to carry out grinding, finishing, wire brushing, sanding, etc. operations. Pedestal grinders, in the well known configurations, typically have a central motor mounted on a pedestal which is fixed to the machine shop floor. The shaft of the motor is usually extended outwardly on both ends to provide a mechanism for attaching grinding, finishing, brushing, sanding wheels and the like to the motor. Thus, two different wheels may be carried by one pedestal grinder. However, as is well known in the art, more than one pedestal grinder, typically three, may be required in a given machine shop to increase productivity and efficiency by avoiding the need to constantly change wheels on a single grinder. This arrangement is subject to objections. Valuable floor space is taken, and the cost of multiple grinders is a factor. It will therefore be appreciated by those skilled in the art that a multispindle pedestal grinder, capable of having six wheels always available without the need to set up for various jobs, would be highly desirable and would further take up little more shop space than a single grinder. The present invention achieves this goal in a simple, highly effective and economic manner.

SUMMARY OF THE INVENTION

These and other objects of the invention are achieved by a multispindle pedestal grinder including: a head block, an indexable head rotatably supported by the head block, a plurality (typically three) of spindles rotatably supported by the indexable head, the axes of rotation of the spindles being parallel to one another and to the axis of rotation of the indexable head, a source of rotating power such as an electric motor; and a belt drive selectively coupling only: a first one of the spindles to the source of rotating power when the indexable head is in a first index position; a second one of the spindles to the source of rotating power when the indexable head is in a second index position; and a third one of the spindles to the source of rotating power when the indexable head is in a third index position.

DESCRIPTION OF THE DRAWING

The subject matter of the invention is particularly pointed out and distinctly claimed in the concluding portion of the specification. The invention, however, both as to organization and method of operation, may best be understood by reference to the following description taken in conjunction with the subjoined claims and the accompanying drawing of which the single FIGURE.

DESCRIPTION OF THE PREFERRED EMBODIMENT(S)

Figure 1:
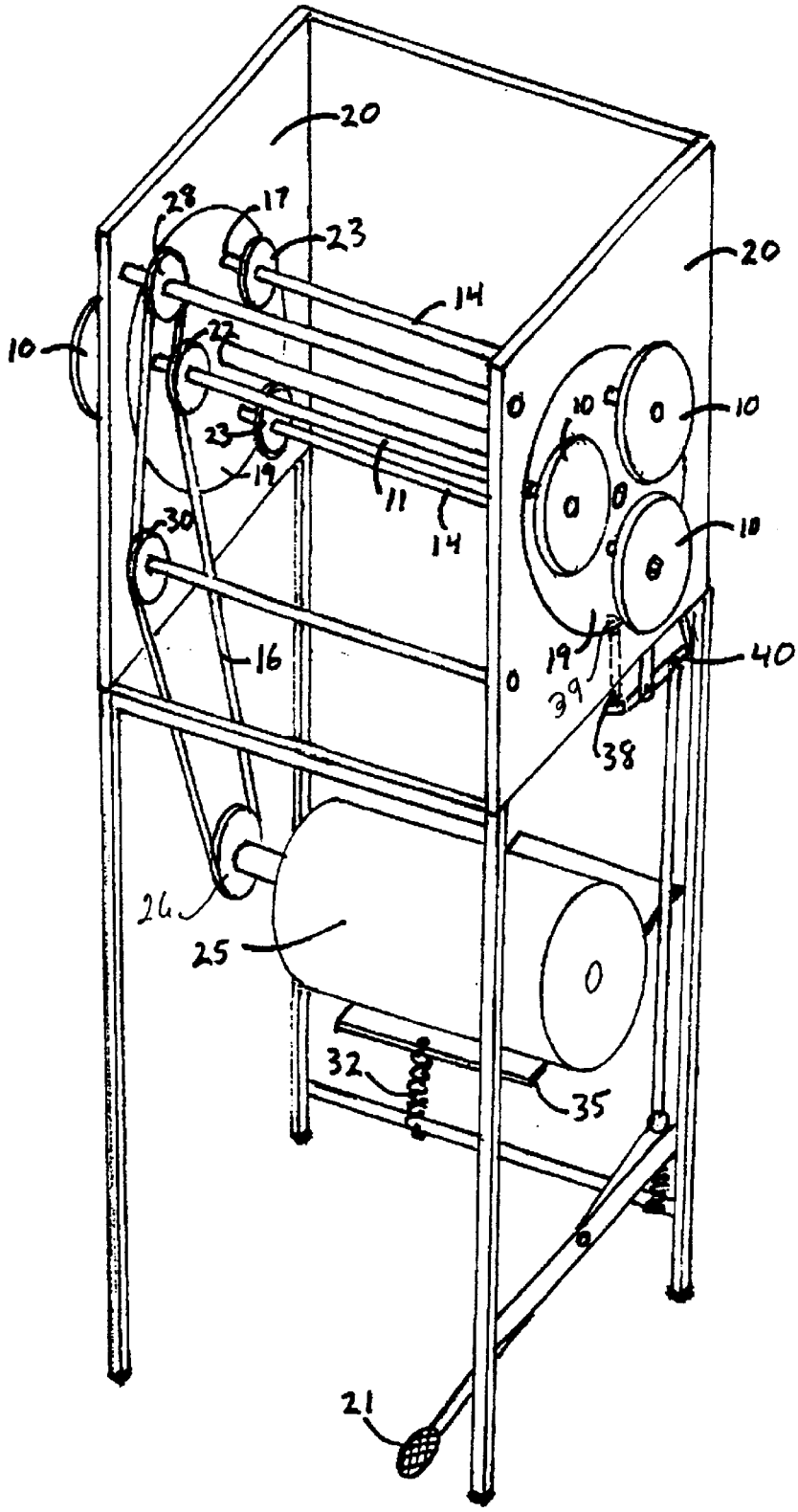
FIG. 1, is a perspective view of a presently preferred embodiment of the subject invention.

The Multispindle Pedestal Grinder, FIG. 1, is made for utilizing a variety 10 of grind stones, wire brushes, and buffing or polishing wheels on the same compact machine.

The well-known pedestal grinders that are available in the marketplace today allow the use of only two positions for grindstones or wire brushes, etc., 10. In contrast, a single pedestal grinder according to the present invention allows room for the use of six positions and with the addition of more spindles, more positions for stones or brushes, etc., could be utilized. It is believed that six different mounting positions would be adequate for a modern machine shop. For example: 1) a course grindstone, 2) a fine grindstone, 3) a greenstone for grinding carbide, 4) a burtex finishing wheel, 5) a wire brush and 6) a sanding flap wheel. Of course, other combinations can be employed.

The Multispindle Pedestal Grinder, FIG. 1, is designed to spin a front spindle 11 only while two other spindles 14 are not spinning. There are two mounting positions on each spindle, one at each end. The spindle 11 in the front position is the only one that makes contact with a double vee driving belt 16 that causes it to rotate. All three spindles are rotated in bushings or bearings 17 that are mounted in an indexable head 19. The indexable head 19 is mounted in a head block 20 by, for example, a grooved condition around its circumference that allows rotation but not side movement (except for clearance). The head block 20 is supported on a stand 12 which may be fixed to the head block. A foot actuating lever 21 serves, upon each actuation, to selectively rotate the indexable head 19 by 120 degrees (one-third of a circle) which is an adequate amount to disengage the front revolving spindle's pulley 22 and engage the next spindle's pulley 23 with the double-sided vee belt 16 so that the next spindle is now in the front position and spinning.

The double-sided vee belt 16 runs in a pulley 26 from a rotating power source, such as an electric motor 25, to a second pulley 28 above the indexable head 19 and then to a third pulley 30 for aligning purposes. Tension on the double-sided vee belt 16 is controlled by the weight of the electric motor 25 assisted by the pull of a spring 32 attached to a pivotal mounting plate 35 to which the motor is attached. This apparatus keeps constant tension on the belt 16 during the indexing of the head 19 which brings another spindle pulley into contact with the belt 16 and removes the previously spinning spindle out of contact with the belt 16.

As stated previously, the indexing of the indexable head 19 is achieved by a foot actuating lever 21. When the foot lever 21 is pressed, a spring-loaded locking pin 38 in the head block 20 is disengaged from a locating hole 39 in the periphery of the indexable head 19 before it is allowed to rotate to the next position. As the indexable head 19 begins to rotate, the locking pin 38 is released from the disengaging lever 40 and tries to relock itself, but as the indexable head 19 is rotating, it is not in the proper circumferential position to receive the locating pin 38 until the next spindle is in the front position and then the pin 38 enters the appropriate locating hole 39. Thus, it will be understood that there is one locating pin 38 and there are three locating holes spaced 120° apart; i.e., one locating hole for fixing each spindle in the driven position.

In summation, it is believed that the Multispindle Pedestal Grinder of the present invention will save time and space in the workshop as it would require three conventional pedestal grinders to provide an equal amount of grindstones, wire brushes and buffing wheels to the working environment. Time is saved because the work force is not required to change grindstones to wire brushes to buffing wheels, etc., as on a conventional pedestal grinder. With the subject invention, all that is necessary is the actuation of a foot pedal to bring a new pair of working tools into operation.

While the principles of the invention have now been made clear in an illustrative embodiment, there will be immediately obvious to those skilled in the art many modifications of structure, arrangements, proportions, the elements, materials, and components, used in the practice of the invention which are particularly adapted for specific environments and operating requirements without departing from those principles.

I claim:

1. A multispindle pedestal grinder comprising:

A) a head block;

B) an indexable head rotatably supported by said head block;

C) foot-actuated indexing means for selectively advancing said indexable head one index position at a time;

D) a plurality of spindles rotatably supported by said indexable head, the axes of rotation of said spindles being parallel to one another and to the axis of rotation of said indexable head;

E) a source of rotating power; and

F) means selectively coupling only:

1) a first one of said spindles to said source of rotating power when said indexable head is in a first index position;

2) a second one of said spindles to said source of rotating power when said indexable head is in a second index position; and 3) a third one of said spindles to said source of rotating power when said indexable head is in a third index position.

2. The multispindle pedestal grinder of claim 1 in which said plurality of spindles is three spindles.

3. The multispindle pedestal grinder of claim 2 in which said source of rotating power is an electric motor.

4. The multispindle pedestal grinder of claim 1 in which said first, second and third index positions are defined by a locking pin selectively engagable with each of a plurality of locking holes equally circumferentially spaced abou the axis of rotation of said head block.

5. The multispindle pedestal grinder of claim 4 in which said plurality of spindles is three spindles.

6. The multispindle pedestal grinder of claim 4 in which said source of rotating power is an electric motor.

7. The multispindle pedestal grinder of claim 4 in which said source of rotating power is an electric motor.

8. The multispindle pedestal grinder of claim 1 in which said source of rotating power is an electric motor.

* * * * *